US008334504B2

(12) United States Patent
Finlay et al.

(10) Patent No.: US 8,334,504 B2
(45) Date of Patent: Dec. 18, 2012

(54) MASS SPECTROMETER SYSTEM

(75) Inventors: Alan Finlay, West Byfleet (GB); Eric Yeatman, London (GB); Alex Onischenko, Guildford (GB); William Boxford, Woking (GB)

(73) Assignee: Microsaic Systems PLC, Woking, Surrey (GB)

( * ) Notice: Subject to any disclaimer, the term of this patent is extended or adjusted under 35 U.S.C. 154(b) by 221 days.

(21) Appl. No.: 12/950,358

(22) Filed: Nov. 19, 2010

(65) Prior Publication Data

US 2011/0127423 A1 Jun. 2, 2011

(30) Foreign Application Priority Data

Nov. 30, 2009 (GB) ..... 0920941.2

(51) Int. Cl.
*H01J 49/26* (2006.01)

(52) U.S. Cl. ..... 250/283; 250/288; 250/251
(58) Field of Classification Search ..... 250/283
See application file for complete search history.

(56) References Cited

U.S. PATENT DOCUMENTS 3,715,590 A * 2/1973 Auer ..... 250/389
3,916,187 A * 10/1975 Fletcher et al. ..... 250/251

FOREIGN PATENT DOCUMENTS

GB 2391694 A 2/2004

* cited by examiner

*Primary Examiner* — Phillip A Johnston
(74) *Attorney, Agent, or Firm* — Bishop & Diehl, Ltd.

(57) ABSTRACT

This invention describes an analytical system where a kinetic impact ionization source is combined with an RF-only ion guide to form a mass spectrometer system for analysis of the elemental and chemical composition of exoatmospheric particles. The kinetic impact ionization source may be used to transform a flux of particle debris into a beam of ions for analysis by a mass analyzer.

22 Claims, 7 Drawing Sheets

MASS SPECTROMETER SYSTEM

CROSS-REFERENCE TO RELATED APPLICATIONS

This application claims the benefit of United Kingdom Patent Application Serial No. GB0920941.2 filed on Nov. 30, 2009.

TECHNICAL FIELD OF THE INVENTION

The invention relates to a mass spectrometer system. In particular, the invention provides a mass spectrometer system comprising an ionisation source configured for impact ionisation that in various configurations acts as a means to transform a dense beam of high energy particles (such as dust) into a beam of ions for analysis in a mass spectrometer. The impact ionisation source may be used to generate a beam of ions from a beam of high velocity particles, the resulting ions may then be collimated into a mass spectrometer detector or mass analyzer for analysis by their mass to charge ratio. This ionisation source may be used as means of analysing the elemental and chemical composition of fast moving dust, ice particles, solid particles, micro-droplets, cosmic debris and interstellar dust in the exoatmosphere, particularly where the density of exoatmospheric debris is such that it may not be adequately analysed using a Time of Flight mass spectrometer. In particular, a kinetic impact ionisation source is described for use as an ion source to transform a high velocity beam of exoatmospheric debris of high flux into a beam of ions for analysis by mass to charge ratio in a quadrupole mass spectrometer.

BACKGROUND OF THE INVENTION

Mass spectrometry (MS) is a powerful analytical technique that is used for the qualitative and quantitative identification of organic molecules, peptides, proteins and nucleic acids. MS offers speed, accuracy and high sensitivity. Key components of a mass spectrometer are the ion source, ion coupling optics, mass analyzer and detector. The ion source transforms analyte molecules into a stream of charged particles, or ions, through a process of electron addition or subtraction. The ions can be 'steered' using electric or magnetic fields. Ion coupling optics or lenses collimate the ion flux from the ion source into the mass analyzer. The analyzer separates ions by their mass to charge ratio. Several different kinds of mass analyzer are known in the art, including, but not limited to; magnetic sector, quadrupole, ion trap, time of flight and cycloidal. The ions exit the analyzer in order of mass to charge ratio and in so doing produces a mass spectrum which is a unique signature or 'fingerprint' for the analyte. Ions are directed to a detector where they impact and discharge an ion current which may be counted and amplified by signal electronics before being displayed on a computer screen as a mass spectrum. The detector is normally an electron multiplier. These components together form the analytical sub-systems of the mass spectrometer system. Other mass spectrometer system components include vacuum pumps, a vacuum chamber, drive electronics, data acquisition electronics, power supplies and enclosures.

It is sometimes necessary to analyse the interstellar dust or cosmic debris. For example, a number of mass spectrometer instruments have been constructed for space science purposes such as determining the composition of a comets tail, or to analyse interstellar dust particles, or to monitor the composition of the earth's ionosphere. In most cases these instruments have been based on an ionisation technique known as impact ionisation. There are several approaches used to analyze hypervelocity ions and particles in outer space. These methods were developed for various space science experiments and deployed as science payloads on space missions such as 'Stardust', 'Genesis', 'Cassini' and 'Galileo'. The most reliable and efficient technique is kinetic impact ionization. In kinetic impact ionisation, a solid particle travelling at very high speeds impacts a solid target manufactured from a special material such as rhodium, gold, platinum, silver etc. The collision of the fast moving particle with the plate releases energy which partially ablates the target, but also generates a minute plume of plasma and ions. Each impact is fast and lasts a few femtoseconds. The ions so generated may be collimated and focussed into a mass spectrometer for analysis.

This method requires the detectable substance to be in the form of solid particles. In an exoatmospheric environment, such particles may be generated from cosmic bodies or man-made satellites. Liquid debris is likely to freeze into solid micro-droplets. Consequently, space debris from a liquid will convert into icy dust and will be suitable for impact ionization as well. The dust or ice particles of interest could have masses of between $10^{-14}$ kg and $10^{-17}$ kg and velocities of 1 km/s up to 10 km/s. These masses correspond to particles with a characteristic size of approximately 0.01 to 10 μm. A number of studies have demonstrated that ionization by kinetic impact is also feasible for liquid clusters of just 5,000 molecules (i.e. ~7 nm size). Thus, impact ionization is likely to be an efficient means of ionising solid and liquid space debris.

The impact of a particle into a surface at high velocity (i.e. >1 km/s) resultant from kinetic impact ionisation (KII) produces vaporization and ionization of both the particle and a portion of the target. The ionization is traditionally held to result from the compression and heating at the point of impact. Various laboratory studies in the early 60's determined a correlation between the degree of ionization generated during an impact and the physical properties of the projectile (principally mass and velocity). In each of these studies the total charge, Q, produced during an impact fitted empirical relationship:

$$Q=Km_p^{\alpha}v^{\beta}$$

where K is a constant for each material (dependent largely on the atomic mass), $m_p$ is the mass of the particle, and is v the impact velocity. Values for a range from 1.33 to 0.154 and seem to show a dependence on both the impact velocity and the experimental conditions. The value of β is usually near 1. The measurements show that for a given particle size an increase in velocity will produce a corresponding rise in the degree of ionization. A similar relationship can be observed experimentally for increasing particle mass. As the velocity and mass of a particle increases the energy released upon impact is greater.

A large proportion of the impact energy is lost in processes such as heating, melting and vaporizing the particle and target plate material. The energy fraction available to ionize the particle is in very small for low velocity impacts and rises to the order of a few percent for hypervelocity impacts. The efficiency with which the particle is ionized is also partially dependent on the incidence angle at which it strikes the target plate.

During kinetic impact ionization the particles of interest collide with the central element of the impact ionizer—the target ionization plate. The plate is usually a disk of a few centimeters in diameter and is made of a metal such as silver or rhodium. The particles have relative velocities of 1-10 km/s. The kinetic energy released in the collision with the ionization plate is sufficient to ionize the particle and some plate material. These ions are then focused into a mass spectrometer for analysis of their masses, traditionally using a time of flight (TOF) mass spectrometer.

Mass spectrometry is undoubtedly the best analytical technique for the analysis of space debris; it has unparalleled sensitivity, selectivity and the flexibility to determine the composition of a wide range of substances. All mass spectrometers are similar in that they can be broken down into six elements as shown in a schematic of the main elements of a typical mass spectrometer in FIG. 1:

- A device to introduce a sample of the compound to be analysed—sample inlet
- A source to generate ions from the sample—ion source
- A mass analyzer to separate the ions according to their mass to charge ratio—mass analyzer
- A detector to register the ions exiting the analyzer—detector
- A computer to control the instrument and to process the data—computer
- A means of relaying, communicating or displaying the mass spectral data—data display There are numerous design options for each of these mass spectrometer components. Established mass analysis techniques can be employed; the choice of which to use is influenced by many factors. The application and specificity of the final instrument is the biggest factor in determining which components are used to make-up the final system. The resulting system can be a highly flexible instrument capable of deployment in a wide range of roles, or a highly "specific to task" instrument unsuited to any other application.

Heretofore, KIIS has been used in the field of space science mostly for compositional and charge analysis of interstellar dust grains or comet particulates. The mass analyzer traditionally coupled with the KIIS for these particular types of space experiments is the "time of flight" mass analyzer or "TOF". A simple linear TOF mass analyzer consists of a flight tube under vacuum at the end of which is an ion detector. The flight tube is held at ground if the ions are created at a positive potential, or if the ion source must be at ground, a liner is used within the flight tube and held at a potential equivalent to the ion acceleration potential. FIG. 2 depicts the principle of (linear) TOF mass separation.

TOF mass analyzers are based on a simple mass separation principle that two ionized species of different masses, with the same start point and time, accelerated by a homogenous constant electrostatic field will achieve velocities related to their mass to charge ratio. Their time of arrival at a detector will therefore directly indicate their masses. This principle is depicted in FIG. 2 and described below.

$$t = \left(\frac{2ms}{eE}\right)^{1/2} + D\left(\frac{m}{2eV_0}\right)^{1/2}$$

where m is the mass of the particle, s is the length of the accelerating region, e is the electronic charge, E is the electrostatic field applied in the accelerating region, D is the length of the field free or 'drift' region and $V_0$ is the accelerating potential.

In the ideal situation outlined above, given a long enough drift time or high enough accelerating potential, high resolution spectra can be achieved for a theoretically unlimited mass range, as the ions reach the detector in distinct 'packets'. However in reality ions are not generated at one point in space and time. Variance within ion sources of initial temporal, spatial and energy distributions of the ions can widen peaks and reduce the resolution of the TOF-MS. In a densely packed ion source space charging can also occur, shielding ions and lowering their velocity as a consequence of the reduced accelerating potential experienced. The effect of spatial distribution is illustrated in FIG. 4. In FIG. 3(*a*) a packet of ions is formed in the ion source. They are all of the same m/z. In FIG. 3 (*b*), taking three individual ions with different initial spatial co-ordinates to represent the group, the ion nearest the extraction grid leaves first but as a consequence experiences the accelerating potential for a shorter time and has a lower kinetic energy. In FIG. 3 (*c*), the ion furthest away from the extraction grid leaves last but has a higher kinetic energy. In FIG. 3 (*d*) at a point in the drift region the faster moving ions will catch up with the slower ones. This is known as the primary focal point F. If a detector were to be located at this primary focal point the resolution would be very high. However in most instruments the primary focal point is only 100 mm beyond the ion source which is not enough flight time for mass peak separation. Therefore the result of putting a detector at point F would be very narrow but overlapping mass peaks. Therefore a longer flight time is necessary to get separation of ion masses but for the remaining flight time after point F the width of the ion packets is increasing, limiting the resolution.

The use of single and double stage reflectors can be used to enhance the resolution whilst increasing the flight time and using pulsed extraction and variable acceleration potentials can limit the spread of velocities of ions of identical m/z ratios leaving the source. These measures increase the flexibility and usefulness of the TOF-MS at the expense of simplicity of the system.

Advantages of the TOF mass analyzer coupled to the KIIS include:

- High sensitivity
- Theoretically unlimited mass range
- Analysis Speed
- Technology is field proven The disadvantages include:

- Spectra could exhibit mass shifting
- Secondary ionization effects
- Ionization event length
- Ion density within the ion source
- Size and complexity of the instrument
- Spectra obtained will be need to be post processed to obtain qualitative data The speed of analysis of the TOF-MS, its sensitivity and the fact that it can produce a complete mass spectrum for each sample particle impact appears to make it the perfect choice for a mass analyzer to be coupled to the KIIS. However, in the scenario where a very large amount of micro-particles must be analyzed in a very short space of time, the KIIS could experience a particle flux of approximately $10^{16}$ particles per second. This is a particle flux much greater than experienced by the TOF instruments previously used in space flight applications, where particle events were in the order of impacts per hour or even per week! Even those used to evaluate the dust particles in the coronas of comets did not experience such a high flux of particles. An ionization event lasting around 10 μs every 0.1 femtoseconds would overwhelm the TOF-MS capability to mass separate the produced ions due to peak broadening from multiple overlapping ionization events and secondary ionization events. Such a high flux would effectively 'swamp' a TOF-MS. Also the amount of ions within the source region could cause space charging further degrading the resolution.

A smaller impact plate area could reduce the particle flux and therefore would reduce the 'swamping' effect of a large number of impacts, but even reducing the impact plate area to 1 $cm^2$ will only result in an order of magnitude reduction in particle flux. The size of a TOF instrument is also a problem, although there are some research groups developing miniature TOF-MS and Quadratic Field Reflection TOF instruments that may be small enough to be viable for the analyse of collision debris application, but of the fully developed instruments currently available none are of a small enough size to be contained in the limited space on an exoatmospheric payload for analysis of impact debris. Furthermore, TOF-MS does not scale well since as you miniaturise the instrument the flight path is shortened and the instrument resolution falls.

Because of these disadvantages, a TOF mass analyzer coupled with a KIIS is not a desirable solution for the analysis of the elemental and molecular composition of a very high flux of high velocity particles under exoatmospheric conditions, yet there is still a need for an analysis system that will allow for this analysis.

SUMMARY OF THE INVENTION

These and other problems are addressed by a system in accordance with the present teaching which can be used for the identification of the elemental and chemical composition of fast moving exoatmospheric particles such as dust, ice particles or impact debris by converting a flux of fast moving particles into ions using a kinetic impact ionisation source and transferring a beam of ions into a multipole RF-only ion guide for analysis. The multipole RF-only ion guide may in certain configurations be provided in the form of a quadrupole mass analyzer or mass spectrometer but it will be appreciated that other configurations of an RF-only ion guide could be used for mass analysis purposes.

In a first embodiment, the mass spectrometer system is a hybrid device based on a kinetic impact ionisation source (KIIS) coupled with a quadrupole mass analyzer. In an exemplary arrangement, the mass spectrometer system is comprised of a quadrupole mass analyzer coupled with the KIIS wherein the quadrupole is operated in 'full scan' mode so that it is scanning the quadrupole mass analyzer's full mass range in order to detect several elemental or chemical species of interest based on their mass spectra.

In another embodiment, the mass spectrometer system is comprised of a quadrupole mass analyzer coupled with the KIIS wherein the quadrupole is operated in 'single ion mode' so that it monitors a single mass to charge ratio to detect a certain elemental or chemical species of interest with a duty cycle of 100%.

In another embodiment, a quadrupole mass analyzer is coupled with the KIIS wherein the quadrupole is operated in 'selected ion mode' such that it monitors several mass to charge ratios to detect several elemental or chemical species of interest with a higher duty cycle than when operated in full scan mode.

Another embodiment of the above hybrid mass spectrometer system is to assemble an array from a plurality of quadrupole mass analyzers and to couple this array with a single, or multiple, kinetic impact ionisation target or targets. The quadrupole mass analyzers of the array could be separately operated in single ion mode to monitor several different mass to charge ratios in order to detect multiple elemental or chemical species of interest with a 100% duty cycle.

Accordingly there is provided a system in accordance with claim 1. Advantageous embodiments are provided in the dependent claims thereto.

These and other features and benefits will be understood with reference to the following exemplary embodiments.

DETAILED DESCRIPTION

Figure 1:
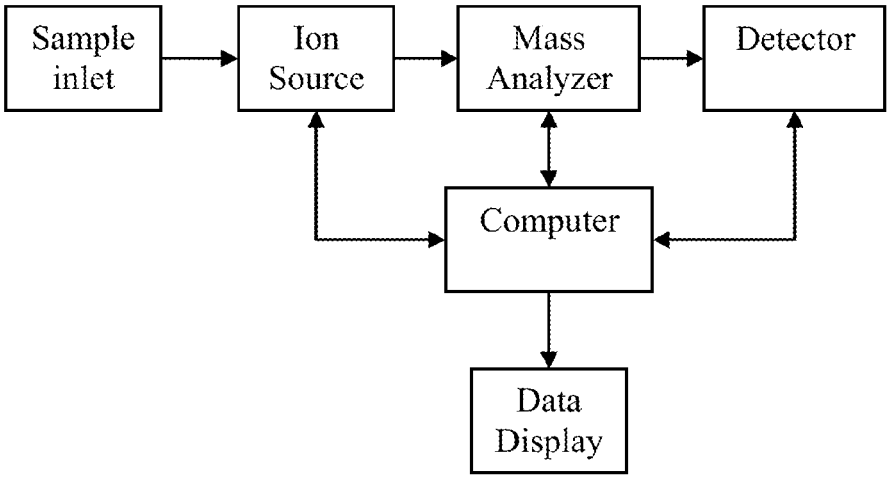
FIG. 1 is a schematic of a classic mass spectrometer system.
Figure 2:
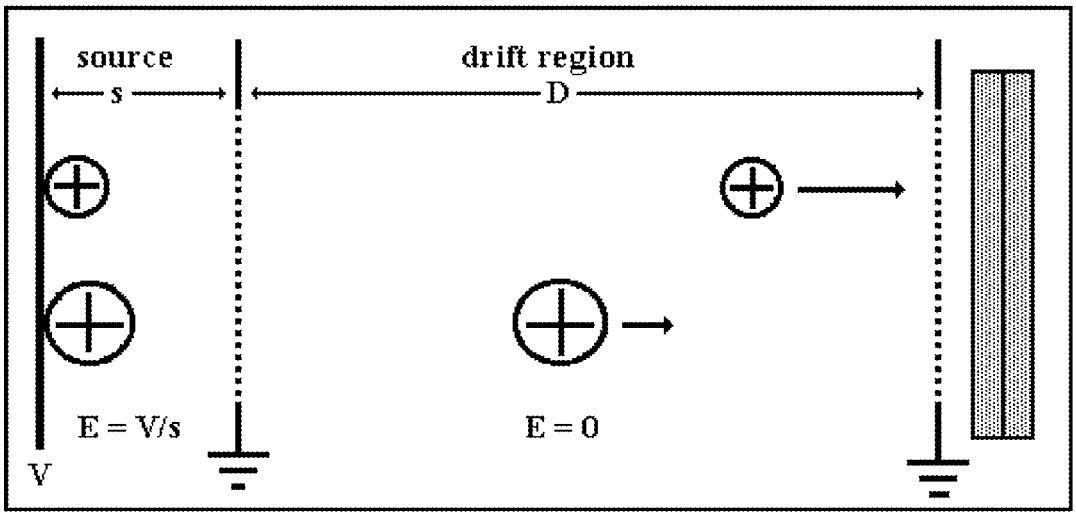
FIG. 2 is a schematic of a time of flight mass spectrometer (TOF-MS).
Figure 3:
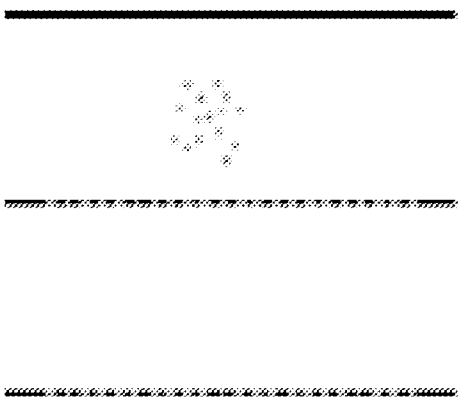
FIGS. 3 (*a*), (*b*), (*c*) and (*d*) describe the operation of a flight mass spectrometer (TOF-MS).
Figure 3:
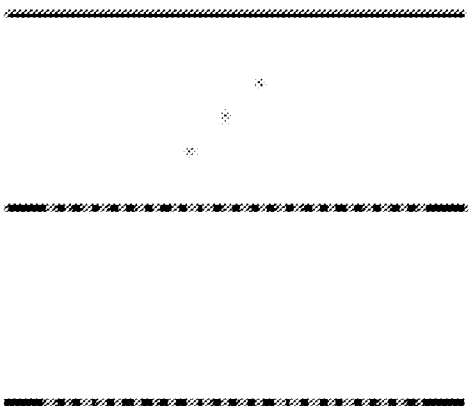
Figure 3:
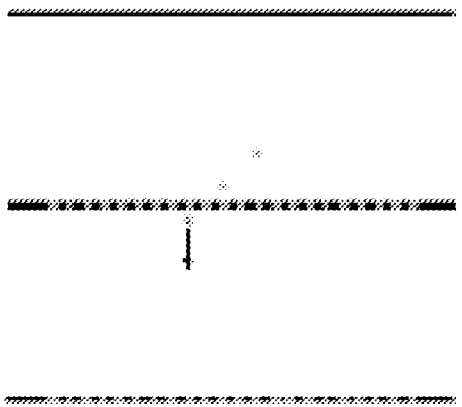
Figure 3D:
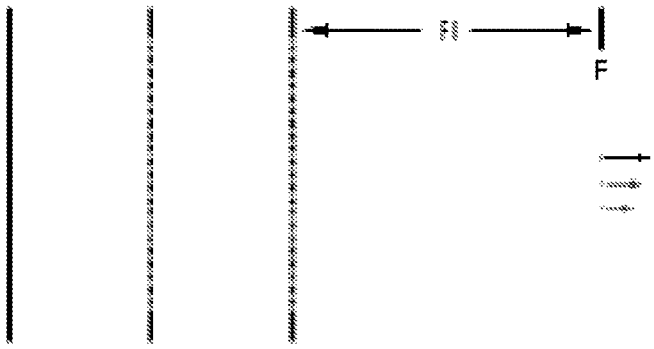

The present inventors have realised that in sampling particles of varying size in a dense cloud of debris in the vacuum of space where, for example, particles to be sampled will be travelling at high velocity, an on-line analysis of the particle composition is required as opposed to sample collection and return to earth for laboratory analysis. A detection system comprising a kinetic impact ionization source (KIIS) coupled to a quadrupole mass spectrometer arrangement provides distinct and specific advantages.

As was described above a KIIS produces ions by employing the kinetic energy of the particle to vaporize and ionize it during impact with a target plate. Once the ions have been produced and extracted from the source, a mass analyzer is required to separate the ions according to their mass to charge ratio and transport them to the detector. The correct choice of mass analyzer has been found to be critical to obtaining usable data from the instrument. In fact, the choice of analyzer will depend on the flux of debris expected in that some analyzers heretofore used to analyse low densities of interstellar debris will not be suitable for analysis of high densities of impact debris. This was discussed above with regard to the saturation problems that could be experienced with time of flight analyzers. The present inventors have realised that use of a multipole RF-only ion guide such as that provided by a quadrupole mass filter whereby the stability of the trajectory of ions in an oscillating electrical field is used to separate ions according to their mass to charge ratio addresses problems associated with the use of the TOF analyzers previously used.

As will be appreciated by those skilled in the art, a quadrupole mass filter consists of four perfectly parallel rods arranged end on around the z axis. Ideally the rods are of hyperbolic cross section; however for ease of manufacture more commonly the sections are circular. Each pair of opposing rods is electrically connected: one pair is subject to an applied potential $U+V\cos\Omega t$ and the other pair to a potential—$(U+V\cos\Omega t)$. Here U is the magnitude of the applied DC voltage, V is the amplitude of the applied RF voltage and $\Omega$ is the angular frequency of the applied RF in radians per second. An ion traveling along the z axis will be subject to a two dimensional quadrupolar field in the x-y plane and undergo oscillations within the x-y plane as a function of its mass to charge ratio. By providing a multipole RF-only ion guide, under the appropriate conditions, ions of a single mass to charge ratio will have a stable trajectory and be transmitted through the length of the rods to the exit where they can impinge on a detector. All other ions will have unstable trajectories which will cause them be ejected from the hyperbolic field or to impact the electrode rods.

It is possible to calculate the regions of stability for an ion of a given mass to charge ratio from expressions derived from the Mathieu equation, $$a_u = \frac{8eU}{mr_0^2\Omega^2}$$

$$q_u = \frac{-4eV}{mr_0^2\Omega^2}$$

Where m is the mass of the ion, and $r_0$ is the radius of the inscribed circle tangential to the inner surface of the electrodes. A quadrupole operates with fixed Ω and $r_0$ so by selecting an appropriate DC to RF ratio it is possible to allow ions of a narrow band of mass to charge ratios to have a stable trajectory in the x and y plane and pass along the rods to be detected.

By increasing the magnitude of the DC and RF potentials whilst keeping the ratio U:V constant it is possible to allow ions of sequentially increasing mass to charge ratio to pass along the rods. By detecting the ion abundance with increasing RF and DC potential it is possible to generate a mass spectrum. As only ions of one m/z ratio can pass through the quadrupole mass filter at a time, to get a complete representative mass spectrum of a compound, the ions generated by the source must be present for the entire time it takes to scan the mass range. Scan speeds are normally around 5,000 amu per second. Depending on the mass range to be covered an entire scan can take just approximately 300 milliseconds. The entire mass range does not have to be scanned in one sweep.

A quadrupole may be operated in selected ion monitoring mode. During selected ion mode the ion abundance at only a few pre-determined mass to charge ratios is measured. This speeds up spectra acquisition time by ignoring those parts of the mass spectrum which contain no information of interest, is of particular use when one knows what ions to look for and needs to verify their presence or absence. However the operator has to be aware of what particular ions they are expecting to observe before using this technique. Commercial instruments normally run at a resolution of 1000 at FWHM; however it is possible to push the resolution up to 4000.

Quadrupole Advantages and Disadvantages

The advantages of combining the KIIS with a quadrupole mass filter include: Size, small and lightweight

- Linearity and resolution of spectra obtained
- Good dynamic range
- Simplicity of operation
- May be miniaturized—scales well with size (e.g. lower power electronics)
- Arrays made be constructed from a plurality of quadrupoles
- Operation in selected ion mode possible—increasing the sensitivity and duty cycle by orders of magnitude.

Therefore the quadrupole mass filter is well suited for the role of analyzing hypervelocity particles and identifying debris and cosmic dust. A quadrupole based instrument would easily fit within the limited space for a science payload without sacrificing performance. The small size and light weight of the quadrupole is a consequence of its manufacture, and quadrupole mass analyzers have been successfully constructed using micro-engineering techniques. The quadrupole has good resolution and sensitivity and the ion optics needed to extract the ions from the source region on to the quadrupole are simple in design and operation.

Since the quadrupole functions as an ion filter rather than an ion collection device problems such as space charging and 'swamping' can be avoided. However, since most of the ion signal is disposed of rather than analyzed a quadrupole mass filter is not ideal for a source in which ions may be present only briefly. Usable spectra can be obtained if the ion flux remains at a high enough level for the entire flight of the instrument through the 'dust cloud' and the resulting mass spectra obtained will be averages of the compounds present during each mass range scan carried out by the quadrupole. This will make qualitative analysis of the mass spectra more difficult but can be overcome with careful calibration and ground testing of the KIIS and quadrupole against species of interest predicted to be present in the cloud of micro-particles. Even more information may be obtained by operating in selected ion mode—one could monitor a handful of m/z values that correspond to the atomic masses and/or molecular weights of the elements and compounds of interest Accordingly, in circumstances where a very high flux of hypervelocity micro-particles is intercepted by a kinetic impact ionisation source, the combination of a KIIS with a quadrupole mass spectrometer is a superior solution. Furthermore, given the scope for miniaturisation of the quadrupole within the limited payload space available, the superior duty cycle offered by selected ion monitoring, the large dynamic range and the correspondingly lower likelihood of the particle flux 'swamping' the analyzer compared with traps and TOFs, and the readiness of available technology the quadrupole is the best choice of mass analyzer to pair with a KIIS A detailed description of preferred exemplary embodiments of the invention is provided with reference to FIGS. 4 to 7.

Figure 4A:
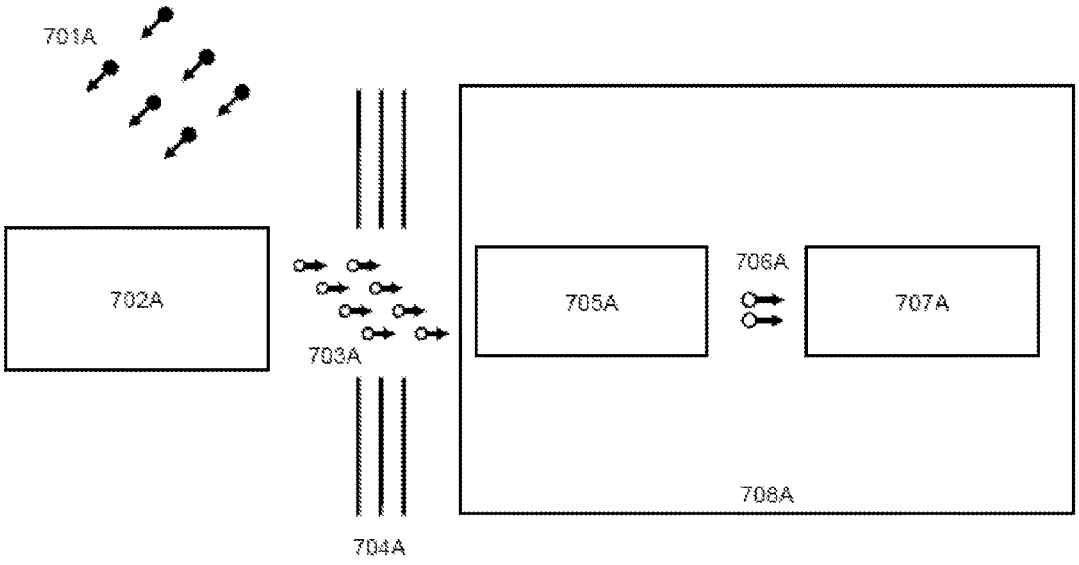
FIG. 4 (*a*) to (*e*) are a schematics of a mass spectrometer system coupled with various KIIS configurations in accordance with the present teaching

FIG. 4A is a diagram of a mass spectrometer system for the conversion of hypervelocity particles 701A into a beam of ions 703A incorporating a kinetic impact ionisation source (KIIS) 702A, optional ion optics 702A, a mass spectrometer 708A including a mass analyzer 705A and an ion detector 707A for counting filtered ions 706A. The ion optics 702A may be electrostatic and formed from a grid, an 'einzel lens' or DC electrodes. The mass analyzer 705A is a quadrupole mass filter. The ion detector 707A may be a faraday plate, a multiplying detector, electron multiplier or a photomultiplier tube (PMT) with scintillator and dynode converter to convert ion counts into photons for detection in the PMT.

Figure 4B:
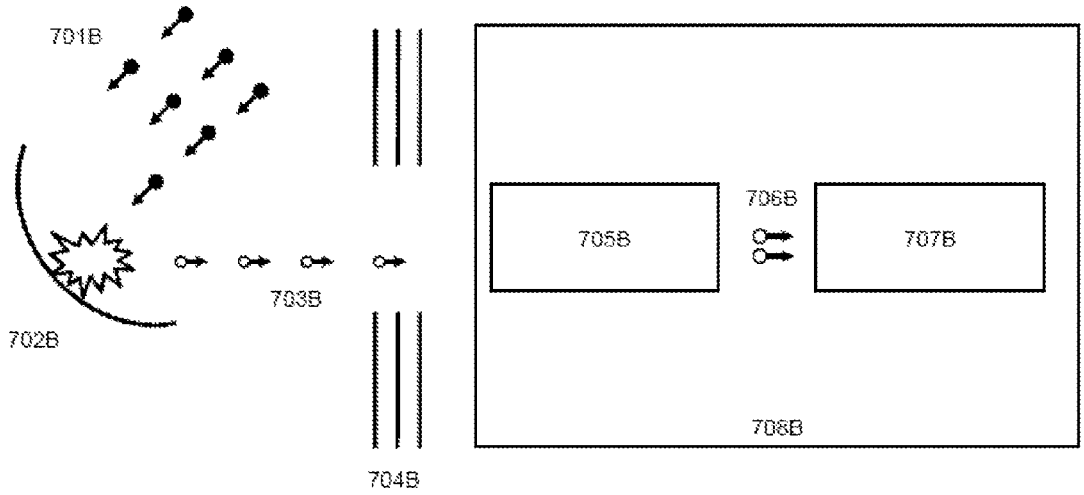

In one embodiment of the kinetic ionisation ion source shown in FIG. 4B, the incident cosmic dust or microparticles 701B impact a curved target plate 702B. Ions 703B are created and collimated into a mass spectrometer 708B containing mass analyzer 705B through ion optics 704B. Ions filtered in the mass analyzer 706B are detected by an ion detector 707B.

Figure 4C:
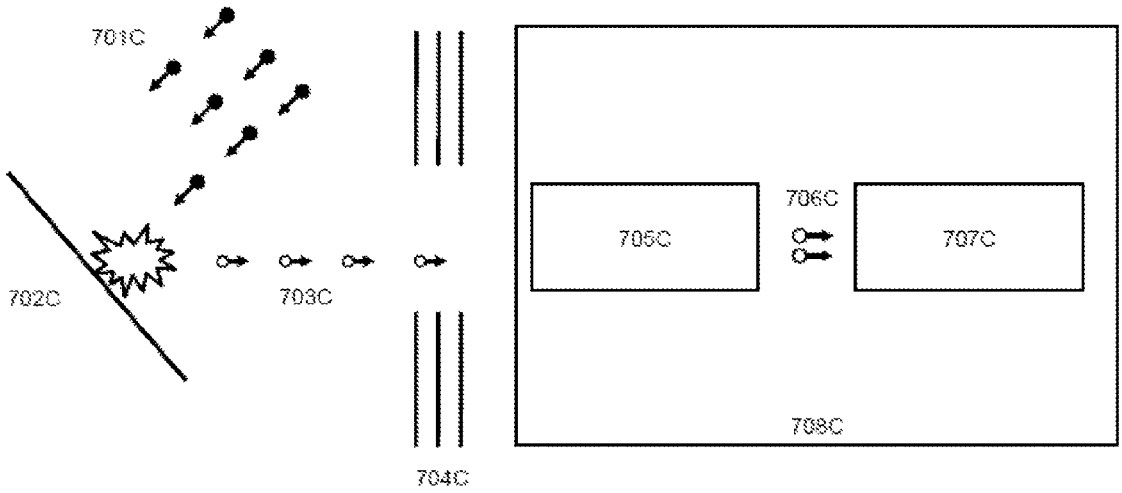

In another embodiment of the kinetic ionisation ion source shown in FIG. 4C, the incident cosmic dust or microparticles 701C impact a flat target plate 702C. Ions 703C are created and collimated into a mass spectrometer 708C containing mass analyzer 705C through ion optics 704C. Ions filtered in the mass analyzer 706C are detected by an ion detector 707C.

Figure 4D:
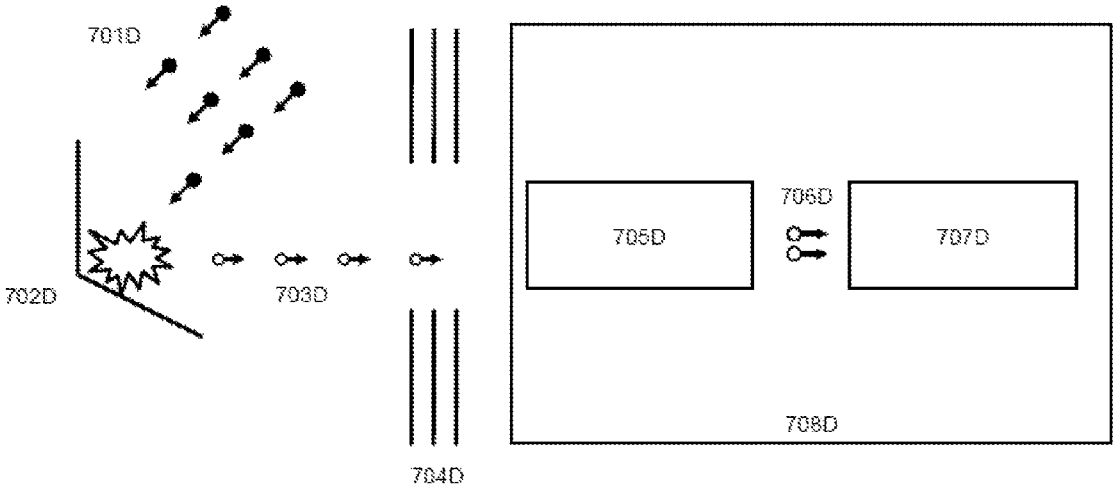

In another embodiment of the kinetic ionisation ion source shown in FIG. 4D, the incident cosmic dust or microparticles 701D impact an angled target plate 702D. The angled target plate 702D may also form a cone in three dimensions. Ions 703D are created and collimated into mass spectrometer 708D containing mass analyzer 705D through ion optics 704D. Ions filtered in the mass analyzer 706C are detected by an ion detector 707D.

Figure 4E:
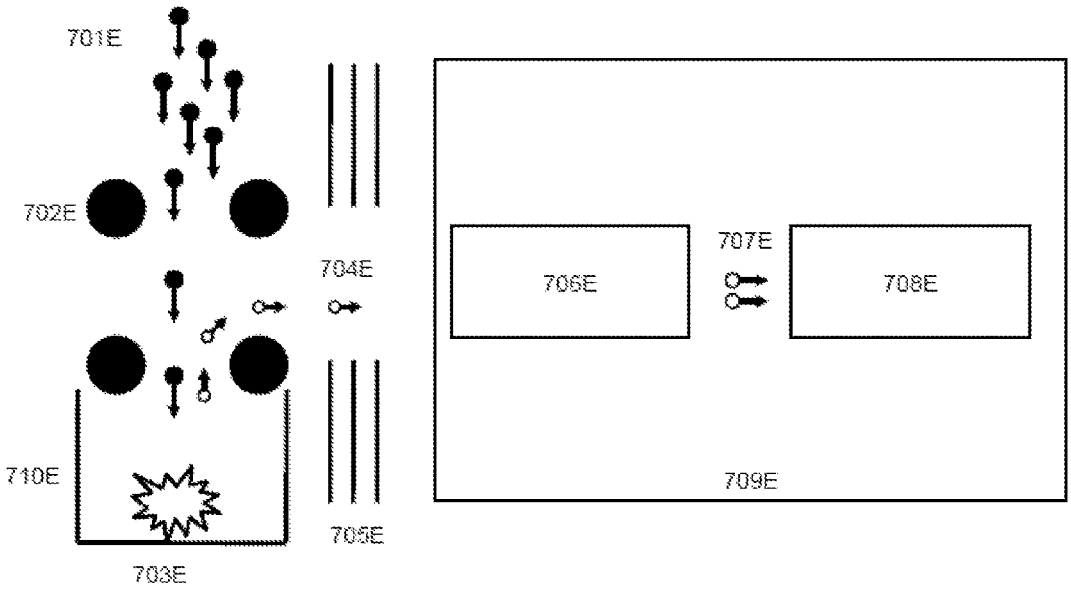

In a more complex embodiment of the kinetic ionisation ion source shown in FIG. 4E, the incident cosmic dust or microparticles 701D impact a target plate 703E. The target plate 703E may also form part of equipotential cage 710E to contain and focus ions. The target plate 703E may be formed from a appropriate metal such as gold, silver, rhodium or platinum that will interact with the incident energetic microparticles 701E to generate optimum ions in a plasma of suitable heat and density. Ions 704D are created and deflected by a quadrupole energy filter 702E formed from four cylindrical electrodes normal to the axis of the mass analyzer 706E. The energy filter 702E applies a field that filters low energy ions preferentially into a mass spectrometer 709E through ion optics 705E. Low energy ions are preferred over high energy ions since higher energy ions are a source of noise at detector 708E. The ions produced by the KIIS 704E are filtered by mass to charge ratio by mass analyzer 706E. Ions filtered in the mass analyzer 707E are detected by an ion detector 708E.

Figure 5:
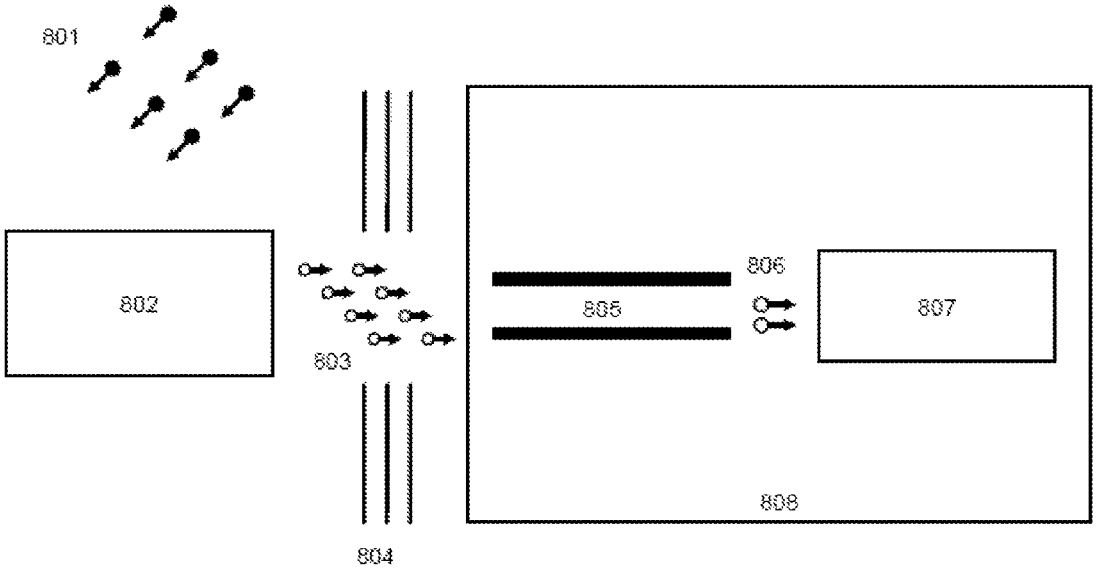
FIG. 5 is a schematic of a quadrupole mass analyzer coupled with a KIIS in accordance with the present teaching.

An exemplary mass spectrometer system that may be used within the context of the present teaching is described in FIG. 5. In FIG. 5, microparticles, debris, frozen droplets or dust 801 are moving at very high velocities through the vacuum of outer space. The dust has a flux which collides with a kinetic impact ionisation source 802. The energy imparted by this collision ionises some fraction of each dust particle. These ions 803 are guided into a mass spectrometer 808. Ion optic components 804 are optional and may be used to guide ions 803 into mass analyzer 805. Mass spectrometer 808 incorporates a quadrupole mass analyzer 805. The quadrupole analyzer 805 filters ions by mass to charge ratio. These mass filtered ions 806 are detected by ion detector 807. A vacuum is provided by the exoatmospheric conditions of outer space.

Figure 6:
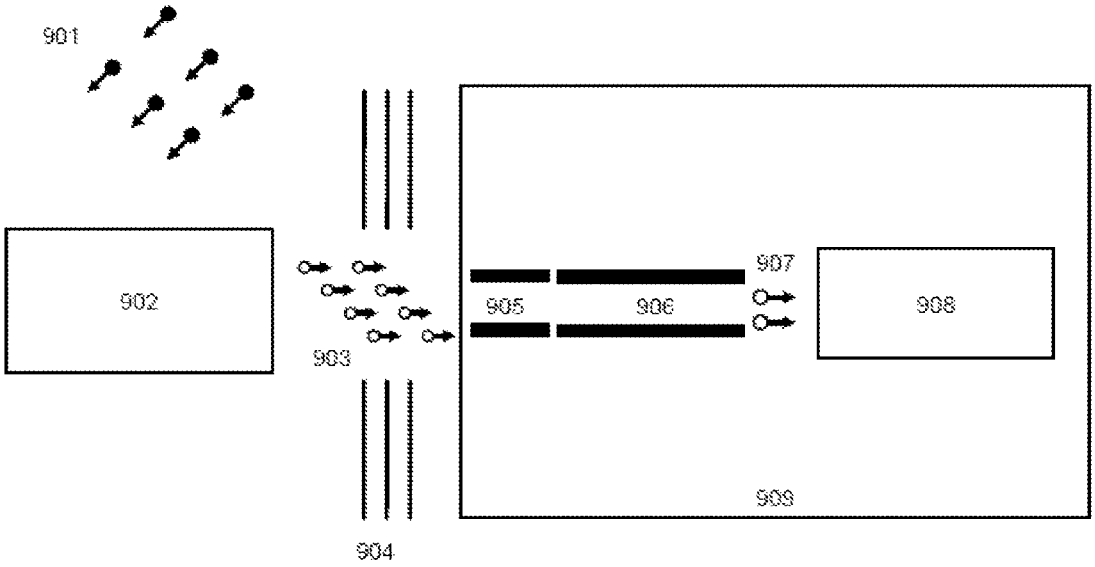
FIG. 6 is a diagram of the mass spectrometer system of the invention where the quadrupole mass analyzer has pre-filter rods.

Another embodiment is shown in FIG. 6. In FIG. 6 microparticles, debris, frozen droplets or dust etc. 901 are moving at very high velocities through the vacuum of outer space. The dust has a flux which collides with a kinetic impact ionisation source 902. The energy imparted by this collision ionises some fraction of each dust particle. These ions 903 are guided into a mass spectrometer 909. Ion optic components 904 are optional and may be used to guide ions 903 into mass analyzer 906. Mass spectrometer 909 incorporates a quadrupole mass analyzer 906. The quadrupole mass analyzer incorporates a RF pre-filter 905. The pre-filter 905 is normally comprised of four short cylindrical rods or 'stubbies' which are axially aligned with the main quadrupole rods and have the same RF voltage as the quadrupole mass analyzer, but not the DC component. This has the effect of significantly increasing the transmission of ions into the quadrupole mass analyzer 906. The quadrupole analyzer 906 filters ions by mass to charge ratio. These mass filtered ions 907 are detected by ion detector 908. A vacuum is provided by the exoatmospheric conditions of outer space.

Figure 7:
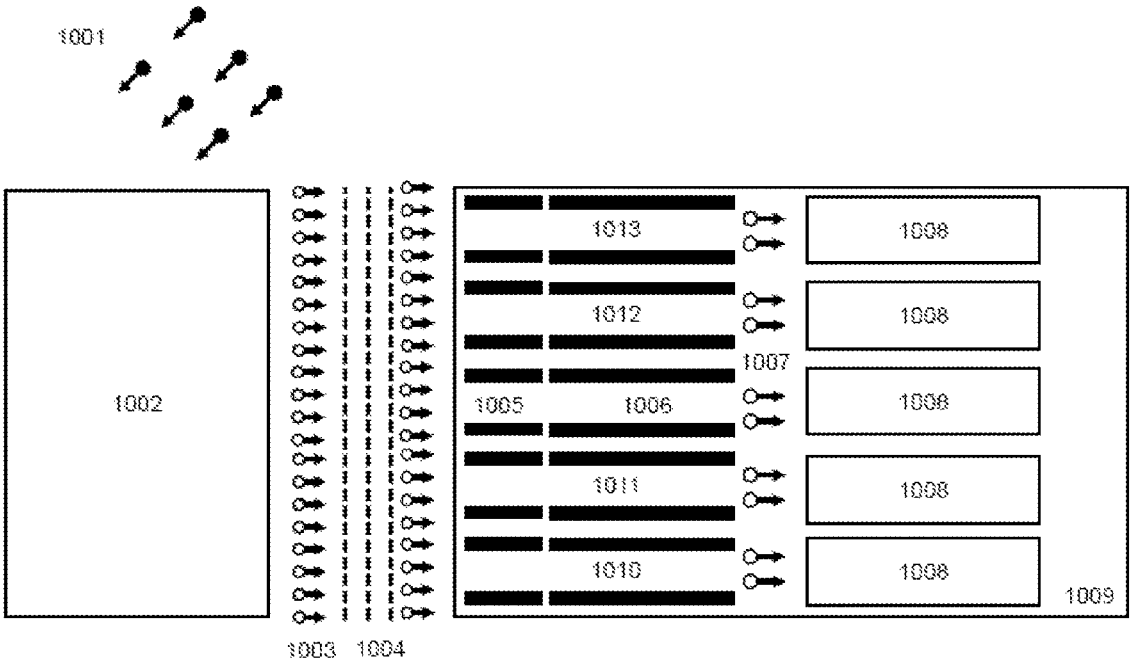
FIG. 7 is a diagram of a KIIS-MS comprising a plurality of quadrupole mass analyzers forming an array of mass spectrometers coupled to a common KIIS.

Another embodiment is described in FIG. 7. In FIG. 7, a flux of microparticles, debris, frozen droplets or dust etc. 1001 is moving at very high velocities through the vacuum of outer space. The dust has a flux which collides with a large area kinetic impact ionisation source 1002. The energy imparted by this collision ionises some fraction of each dust particle. These ions 1003 are guided into a mass spectrometer 1009. Ion optic components 1004 are optional and may be used to guide ions 1003 into an array of mass analyzers 1006, 1010, 1011, 1012 and 1013. The array is not limited to five analyzers. Mass spectrometer 1009 incorporates an array of quadrupole mass analyzers 1006, 1010, 1011, 1012 and 1013. These quadrupole mass analyzer incorporate RF pre-filters. These pre-filters have the effect of significantly increasing the transmission of ions into the quadrupole mass analyzer 1006, 1010, 1011, 1012 and 1013. The quadrupole analyzers filter ions by mass to charge ratio. These mass filtered ions 1007 are detected by ion detector 1008. A vacuum is provided by the exoatmospheric conditions of outer space. In this array, the quadrupole mass analyzers may be operated in parallel, increasing system sensitivity and selectivity. If all the analyzers scan the entire mass range simultaneously, then the sensitivity increases by N where N is the number of mass analyzers in the array. ON the other hand, each analyzer may be used to monitor a certain mass to charge ratio, increasing the system selectivity and duty cycle. This feature may be particularly valuable when analysing a very high flux of microparticles over a very short period of time.

It will be appreciated that what has been described herein are exemplary arrangements of an interface mass spectrometer system for coupling ions generated within a kinetic impact ionisation source into a mass spectrometer for subsequent analysis. The kinetic impact ionisation component includes a target with which particles may collide releasing plasma containing ions, and ion optics defining an interior path through which the ions may pass. At least a portion of this interior path includes electrode surfaces which generate electrostatic or electrodynamic fields. As a result ions, passing within this optical region will undergo focussing, or a filtering out of undesirable high energy ions. Such an arrangement may be provided by a feature of the type known as a quadrupole energy filter.

While the invention has been described with reference to different arrangements or configurations it will be appreciated that these are provided to assist in an understanding of the teaching of the invention and it is not intended to limit the scope of the invention to any specific arrangement or embodiment described herein. Modifications can be made to that described herein without departing from the spirit or scope of the teaching of the present invention. Furthermore where certain integers or components are described with reference to any one figure or embodiment it will be understood that these could be replaced or interchanged with those of another figure—or indeed by elements not described herein—without departing from the teaching of the invention. The present invention is only to be construed as limited only insofar as is deemed necessary in the light of the appended claims.

The words comprises/comprising when used in this specification are to specify the presence of stated features, integers, steps or components but does not preclude the presence or addition of one or more other features, integers, steps, components or groups thereof.

The invention claimed is:

1. An exoatmospheric detection system for the analysis of the elemental and chemical composition of high velocity micro-particles, dust or debris under exoatmospheric conditions, the system comprising a kinetic impact ionisation source and a RF-only ion guide.

2. The system of claim 1 wherein the RF-only ion guide is a multipole RF-only ion guide.

3. The system of claim 1 wherein the RF-only ion guide is coupled to a mass analyzer.

4. The system of claim 3 wherein the mass analyzer is a quadrupole mass analyzer.

5. The system of claim 3 being operable in a full scan mode scan, the mass analyzer comprising a full mass range sufficient to detect several elemental or chemical species of interest based on their mass spectra.

6. The system of claim 3 being operable in a single ion mode to monitor a single mass to charge ratio to detect a certain elemental or chemical species of interest with a duty cycle of 100%.

7. The system of claim 3 being operable in a selected ion mode to monitor several mass to charge ratios to detect several elemental or chemical species of interest with a higher duty cycle than when operated in full scan mode.

8. The system of claim 1 comprising a plurality of RF-only ion guides provided in an array, the array being coupled to at least one kinetic impact ionisation source.

9. The system of claim 8 wherein the individual ones of the plurality of RF-only ion guide are operable in parallel with others of the plurality of RF-only ion guide.

10. The system of claim 8 wherein the array is coupled to a plurality of kinetic impact ionisation sources.

11. The system of claim 8 wherein the array of RF-only ion guides is coupled to a plurality of mass analyzers.

12. The system of claim 11 wherein individual mass analyzers are configured to be operable in single ion mode to monitor several different mass to charge ratios in order to detect multiple elemental or chemical species of interest with a 100% duty cycle.

13. The system of claim 3 comprising at least one RF pre-filter operably providing an increment in the transmission of ions into the mass analyzer.

14. The system of claim 1 wherein the kinetic impact ionisation source comprises a target plate, which on operable contact with high velocity micro-particles, dust or debris effects a generation of ions.

15. The system of claim 14 wherein the target plate is curved.

16. The system of claim 14 wherein the target plate is planar.

17. The system of claim 14 wherein the plate comprises first and second surfaces offset from one another.

18. The system of claim 14 wherein the target plate defines a cone in three dimensions.

19. The system of claim 14 wherein the target plate forms part of equipotential cage to contain and focus ions.

20. The system of claim 14 whereby the target plate is formed from one of gold, silver, rhodium or platinum selected to interact incident energetic microparticles to generate ions in a plasma.

21. The system of claim 1 comprising an ion detector, the ion detector providing for a detection of ions filtered by the RF-only ion guide.

22. An exoatmospheric detection system comprising a kinetic impact ionisation source, a RF-only ion guide, a mass analyzer and an ion detector, the system being configured for the analysis of the elemental and chemical composition of high velocity micro-particles, dust or debris under exoatmospheric conditions, the system comprising an inlet for effecting introduction of the elemental and chemical composition of high velocity micro-particles, dust or debris, the introduced particles being directed to a target plate where they operably transform into ions which are collimated through the RF-only ion guide, filtered by the mass analyzer and detected by the ion detector.

* * * * *